US012710215B2

(12) United States Patent
Ishiki et al.

(10) Patent No.: US 12,710,215 B2
(45) Date of Patent: Aug. 18, 2026

(54) HEAT EXCHANGE UNIT AND REFRIGERATION CYCLE DEVICE

(71) Applicant: Mitsubishi Electric Corporation, Tokyo (JP)

(72) Inventors: Natsumi Ishiki, Tokyo (JP); Kazunari Sawada, Tokyo (JP); Kentaro Nagaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 164 days.

(21) Appl. No.: 18/707,204

(22) PCT Filed: Mar. 25, 2022

(86) PCT No.: PCT/JP2022/014250
§ 371 (c)(1),
(2) Date: May 3, 2024

(87) PCT Pub. No.: WO2023/181325
PCT Pub. Date: Sep. 28, 2023

(65) Prior Publication Data
US 2024/0328701 A1 Oct. 3, 2024

(51) Int. Cl.
*F25D 17/06* (2006.01)
*F25B 39/02* (2006.01)

(52) U.S. Cl.
CPC ..... *F25D 17/067* (2013.01); *F25B 39/02* (2013.01)

(58) Field of Classification Search
CPC ..... F25B 49/02; F25B 39/02; F25D 17/067; F24F 1/16; F24F 1/0068; F24F 1/20;
(Continued)

(56) References Cited

U.S. PATENT DOCUMENTS

2015/0043133 A1* 2/2015 Yanase ..... F25D 23/006 361/627
2018/0372344 A1* 12/2018 Abukawa ..... F24F 1/10
(Continued)

FOREIGN PATENT DOCUMENTS

EP 2846107 A1 3/2015
JP 10-111072 A 4/1998
(Continued)

OTHER PUBLICATIONS

International Search Report of the International Searching Authority mailed May 17, 2022 in corresponding International Patent Application No. PCT/JP2022/014250 (and English translation).

*Primary Examiner* — Len Tran
*Assistant Examiner* — Kamran Tavakoldavani
(74) *Attorney, Agent, or Firm* — Posz Law Group, PLC

(57) ABSTRACT

A heat exchange unit includes: a housing having first and a second rooms, and a control unit disposed so as to straddle between the insides thereof. The rooms are adjacently disposed. The control unit has an electric components box disposed on the inside of the first room, a wire that extends to the inside of the second room from a lead-out hole, a first wall, and a second wall. The wire extends from the inside of a space between the first and second room, and second through holes formed on the second wall. A surface out of the first wall faces the second through hole formed on the second wall. An end of the top side, and both ends in a second direction are closed off. The space has an opening that opens to the bottom side, and the opening opens to the inside of the first room.

12 Claims, 8 Drawing Sheets

(58) Field of Classification Search
CPC ..... F24F 1/24; F24F 1/46; F24F 11/36; F24F 11/88; F24F 11/89
See application file for complete search history.

(56) References Cited

U.S. PATENT DOCUMENTS

| | | | | |
|---|---|---|---|---|
| 2020/0158353 | A1* | 5/2020 | Nakagawa | F24F 1/22 |
| 2021/0239331 | A1* | 8/2021 | Kadu | F24F 1/22 |
| 2023/0044599 | A1* | 2/2023 | Liu | F24F 1/031 |

FOREIGN PATENT DOCUMENTS

| | | | |
|---|---|---|---|
| JP | 2015-059735 | A | 3/2015 |
| WO | 2013/145014 | A1 | 10/2013 |

* cited by examiner

HEAT EXCHANGE UNIT AND REFRIGERATION CYCLE DEVICE

CROSS REFERENCE TO RELATED APPLICATION

This application is a U.S. national stage application of PCT/JP2022/014250 filed on Mar. 25, 2022, the contents of which are incorporated herein by reference.

TECHNICAL FIELD

The present disclosure relates to a heat exchange unit and refrigeration cycle device.

BACKGROUND ART

An air conditioner having an electric components box mounted thereon is known. For example, in Patent Document 1, a shutter plate for closing a part of a slit used for passing through wires that are provided in an electric components box main body, is provided on a cover of the electric components box.

CITATION LIST

Patent Document

Patent Document 1

Japanese Unexamined Application No. 2015-59735, First Publication

SUMMARY OF INVENTION

Problem to be Solved by the Invention

For example, in a shutter plate as the aforementioned, the object of providing such shutter plate is to suppress a refrigerant that has leaked from penetrating to an inside of an electric components box. With the aforementioned shutter plate however, there are cases where suppressing the refrigerant that has leaked from penetrating to the inside of the electric components box is not sufficient.

The present disclosure has been made in order to address the problem above, and one object is to provide a heat exchange unit having a structure that suitably suppresses penetration of refrigerant to an inside of an electric components box, and to provide a refrigeration cycle device that includes such heat exchange unit.

Means to Solve the Problem

A heat exchange unit of a refrigeration cycle device according to the present disclosure includes: a housing having a first room and a second room that are portioned from one another by a partition member; a heat exchanger that is disposed on an inside of the first room; a blower that is disposed on the inside of the first room; a refrigerant pipe that is disposed on an inside of the second room and that is connected to the heat exchanger, and a control unit that is disposed so as to straddle between the inside of the first room and the inside of the second room. The first room and the second room are adjacently disposed in a first direction that intersects a vertical direction. The control unit has an electric components box disposed on the inside of the first room, a wire that extends to the inside of the second room after being pulled out from a lead-out hole, a first wall located between the electric components box and the inside of the second room, and a second wall located between the first wall and the inside of the second room. A space is formed between the first wall and the second wall. The wire extends from the inside of the first room to the inside of the second room, via the space, passing through a second through hole out of second through holes that are formed on the second wall. A surface out of the first wall that faces the space, faces the second through hole out of second through holes that are formed on the second wall in the first direction. An end of the top side out of the space in the vertical direction, and both ends in a second direction that intersects with the vertical direction and is orthogonal to the first direction out of the space, are closed off. The space has an opening that opens to the bottom side in the vertical direction, and the opening opens to the inside of the first room.

A refrigeration cycle device according to the present disclosure includes an outdoor unit, and an indoor unit, wherein the outdoor unit or the indoor unit may be the heat exchange unit mentioned above.

Effects of the Invention

According to an embodiment of the present disclosure, in an electric components box of a refrigeration cycle device, it is possible to suitably suppress penetration of refrigerant to an inside of the electric components box.

DESCRIPTION OF EMBODIMENTS

Figure 1:
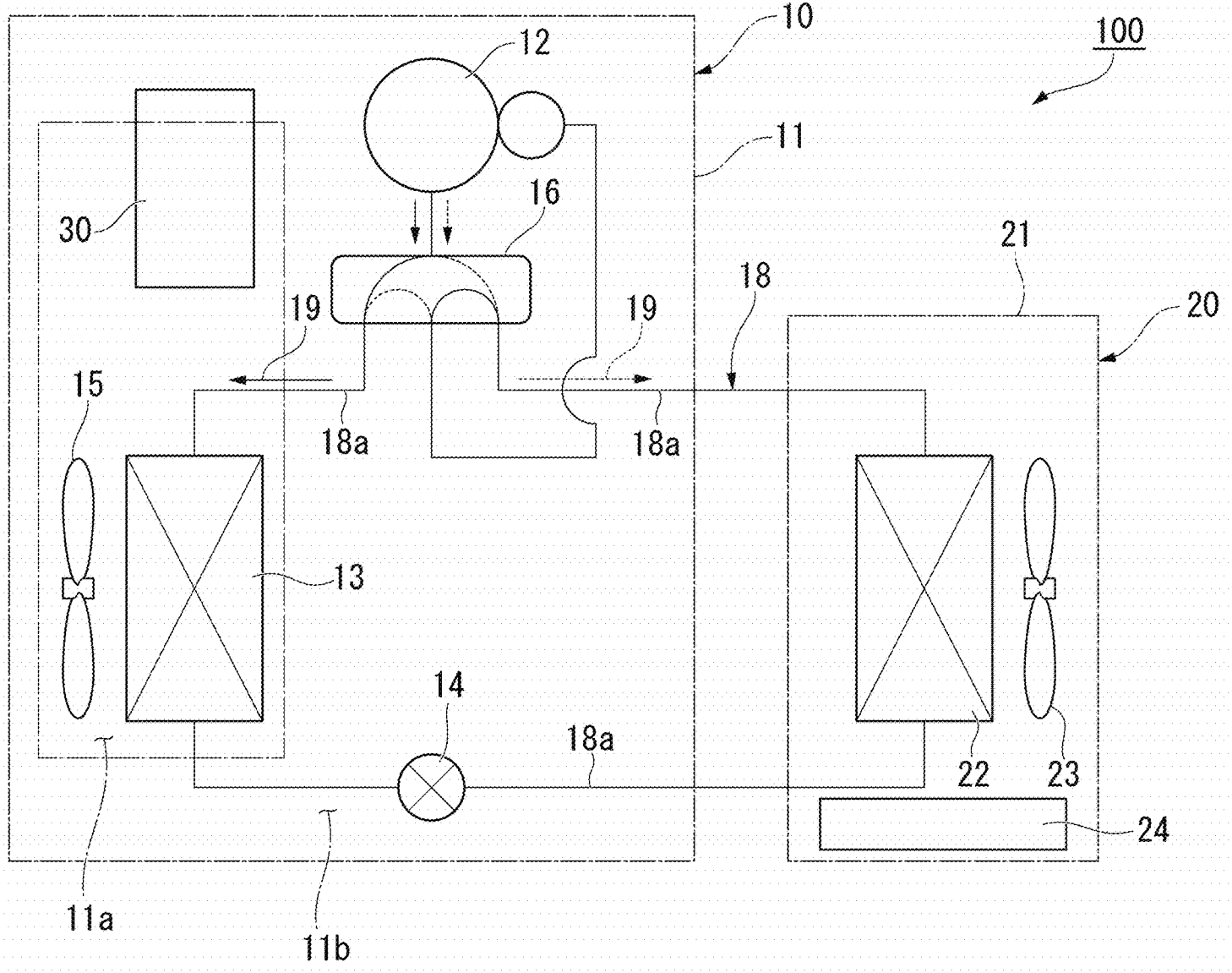
FIG. 1 A schematic view that shows an outline configuration of a refrigeration cycle device in an embodiment.

Hereinafter, an embodiment of the present disclosure is explained with reference to the drawings. The scope of the present disclosure is not limited to the embodiment below, and may be changed so long as the embodiment do not depart from the technical scope of the present disclosure. In the drawings below, scales and dimensions of various configurations may differ from scales and dimensions in the drawings below, to facilitate better understanding of the various embodiments.

The drawings show an X axis, a Y axis, and a 7, axis where appropriate. The X axis shows a side out of sides of a horizontal direction. The Y axis shows another side out of sides of the horizontal direction. The 7, axis shows a vertical direction. In the explanation below, a horizontal direction along the X axis is referred to as a "front-rear direction X", and a horizontal direction along the Y axis is referred to as a "left-right direction Y". A vertical direction is referred to as a "vertical direction 7". The front-rear direction X, the left-right direction Y, and the vertical direction Z are mutually orthogonal directions. In the explanation below, a side out of sides of the vertical direction Z in which an arrow of the Z axis faces is a top side (+Z side). The other side out of sides of the vertical direction Z, which faces an opposite side the arrow of the Z axis faces is a bottom side (−Z side). A side out of sides of the front-rear direction X in which an arrow of the X axis faces is a front side (+X side). A side out of sides of the front-rear direction X which faces an opposite side the arrow of the X axis faces is a rear side (−X side). The left-right direction Y in the embodiment below, is the left-right direction Y in a case where an outdoor unit 10 is viewed from the front side (+X side). In other words, a side out of sides of the left-right direction Y in which an arrow of the Y axis faces is a right side (+Y side). A side out of sides in the left-right direction Y which faces an opposite side the arrow of the Y axis faces is a left side (−Y side). In the embodiment below, a direction where the left-right direction Y intersects with the vertical direction Z is referred to as a "first direction". The front-rear direction X corresponds to a "second direction" which intersects the vertical direction 7, and is orthogonal to the first direction.

FIG. 1 is a schematic view that shows an outline configuration of a refrigeration cycle device 100 in the embodiment. The refrigeration cycle device 100 is a device that uses a refrigeration cycle in which a refrigerant 19 is circulated. The refrigeration cycle device 100 in the embodiment is an air conditioner. As shown in FIG. 1, the refrigeration cycle device 100 includes the outdoor unit 10, an indoor unit 20, and a circulation path 18. The outdoor unit 10 is disposed outdoors. The indoor unit 20 is disposed indoors. The outdoor unit 10 and the indoor unit 20 are connected by the circulation path 18 that circulates a refrigerant 19. The outdoor unit 10 and the indoor unit 20 are heat exchange units that conduct heat exchange with air.

By having the refrigerant 19 that flows within the circulation pathway 18, and the indoor unit 20 conduct heat exchange with air indoors, it is possible for the air conditioner 100 to adjust a temperature of the air indoors. A refrigerant such as a fluorine based refrigerant with a low global warming potential (GWP: Global Warming Potential), or a hydrocarbon based refrigerant or the like may be mentioned as examples of the refrigerant 19. A density of the refrigerant 19 in a gaseous state is larger than a density of air. Here, the fluorine based refrigerant with a low global warming potential is for example, HFC32. An example of the hydrocarbon based refrigerant is R290 (propane). Both the fluorine based refrigerant and the hydrocarbon based refrigerant are flammable refrigerants.

The outdoor unit 10 includes a housing 11, a compressor 12, a heat exchanger 13, a flow adjustment valve 14, a blower 15, a four-way valve 16, a refrigerant pipe 18*a*, and a control unit 30. The compressor 12, the heat exchanger 13, the flow adjustment valve 14, the blower 15, the four-way valve 16, the refrigerant pipe 18*a* and the control unit 30 are housed on an inside of the housing 11.

Out of the circulation pathway 18, the compressor 12, the heat exchanger 13, the flow adjustment valve 14, and the four-way valve 16 are provided on a portion located on the inside portion of the housing 11. Out of the circulation pathway 18, the compressor 12, the heat exchanger 13, the flow adjustment valve 14, and the four-way valve 16 are connected by a portion located on the inside portion of the housing 11.

Out of the circulation pathway 18, the four-way valve 16 is provided on a part that is connected to a discharge side of the compressor 12. By exchanging a portion of the circulation pathway 18, it is possible for the four-way valve 16 to reverse a direction of flow of the refrigerant 19 within the circulation pathway 18. When the path connected by the four-way valve 16 is the path of the four-way valve 16 that is shown by solid lines in FIG. 1, the refrigerant 19 within the circulation pathway 18 flows in the direction shown by the solid line arrow in FIG. 1. On the other hand, when the path connected by the four-way valve 16 is the path of the four-way valve 16 that is shown by dashed lines in FIG. 1, the refrigerant 19 flows within the circulation pathway 18 in the direction shown by the dashed line arrow in FIG. 1.

The refrigerant pipe 18*a* is a pipe that configures a portion of the circulation pathway 18. The refrigerant pipe 18*a* is connected to a pipe that extends from the indoor unit 20. A plurality of refrigerant pipes 18*a* are provided on an inside of the housing 11 of the outdoor unit 10.

The indoor unit 20 includes a housing 21, a heat exchanger 22, a blower 23, and a controller 24. The housing 21 houses the heat exchanger 22, the blower 23, and the controller 24 on an inside thereof. It is possible for the indoor unit 20 to have a cooling operation where the air of the room the indoor unit 20 is disposed in is cooled, and to have a heating operation where the air of the room the indoor unit 20 is disposed in is heated.

When the indoor unit 20 is operated in the cooling operation, the refrigerant 19 that flows within the circulation pathway 18 flows in the direction shown by solid lines in FIG. 1. In other words, when the indoor unit 20 is operated in the cooling operation, the refrigerant 19 that flows within the circulation pathway 18 circulates so as to return to the compressor 12 after passing through the compressor 12, the heat exchanger 13 of the outdoor unit 10, the flow adjustment valve 14, and the heat exchanger 22 of the indoor unit 20 in such an order. During the cooling operation, the heat exchanger 13 of the outdoor unit 10 functions as a condenser, and the heat exchanger 22 of the indoor unit 20 functions as an evaporator.

On the other hand, when the indoor unit 20 is operated in the heating operation, the refrigerant 19 that flows within the circulation pathway 18 flows in the direction shown by dashed lines in FIG. 1. In other words, when the indoor unit 20 is operated in the heating operation, the refrigerant 19 that flows within the circulation pathway 18 circulates so as to return to the compressor 12 after passing through the compressor 12, the heat exchanger 22 of the indoor unit 20, the flow adjustment valve 14, and the heat exchanger 13 on an inside of the outdoor unit 10 in such an order. During the heating operation, the heat exchanger 13 of the outdoor unit 10 functions as the evaporator, and the heat exchanger 22 on an inside of the indoor unit 20 functions as the condenser.

Figure 2:
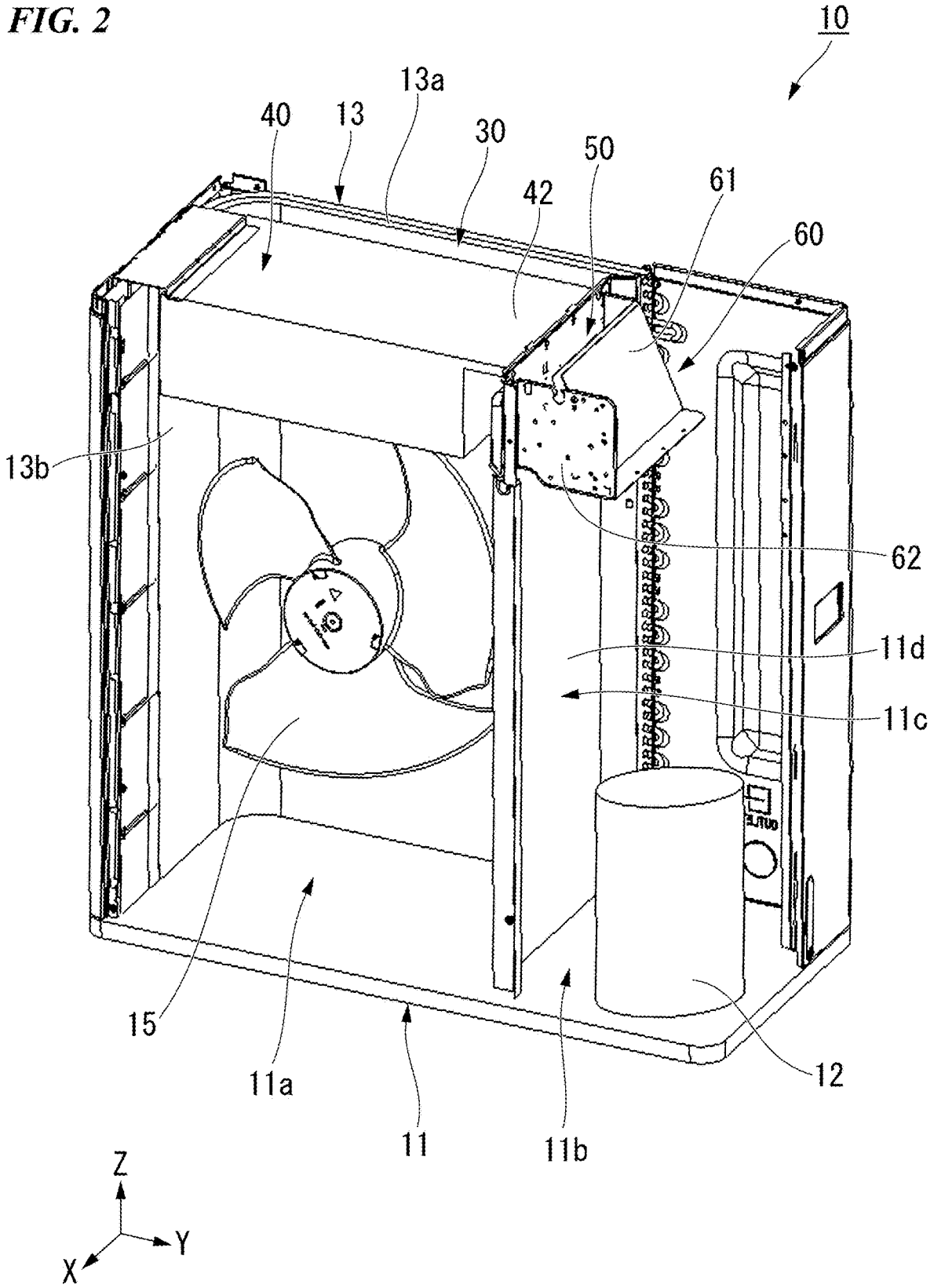
FIG. 2 A perspective view that shows a portion of an outdoor unit in the embodiment.
Figure 3:
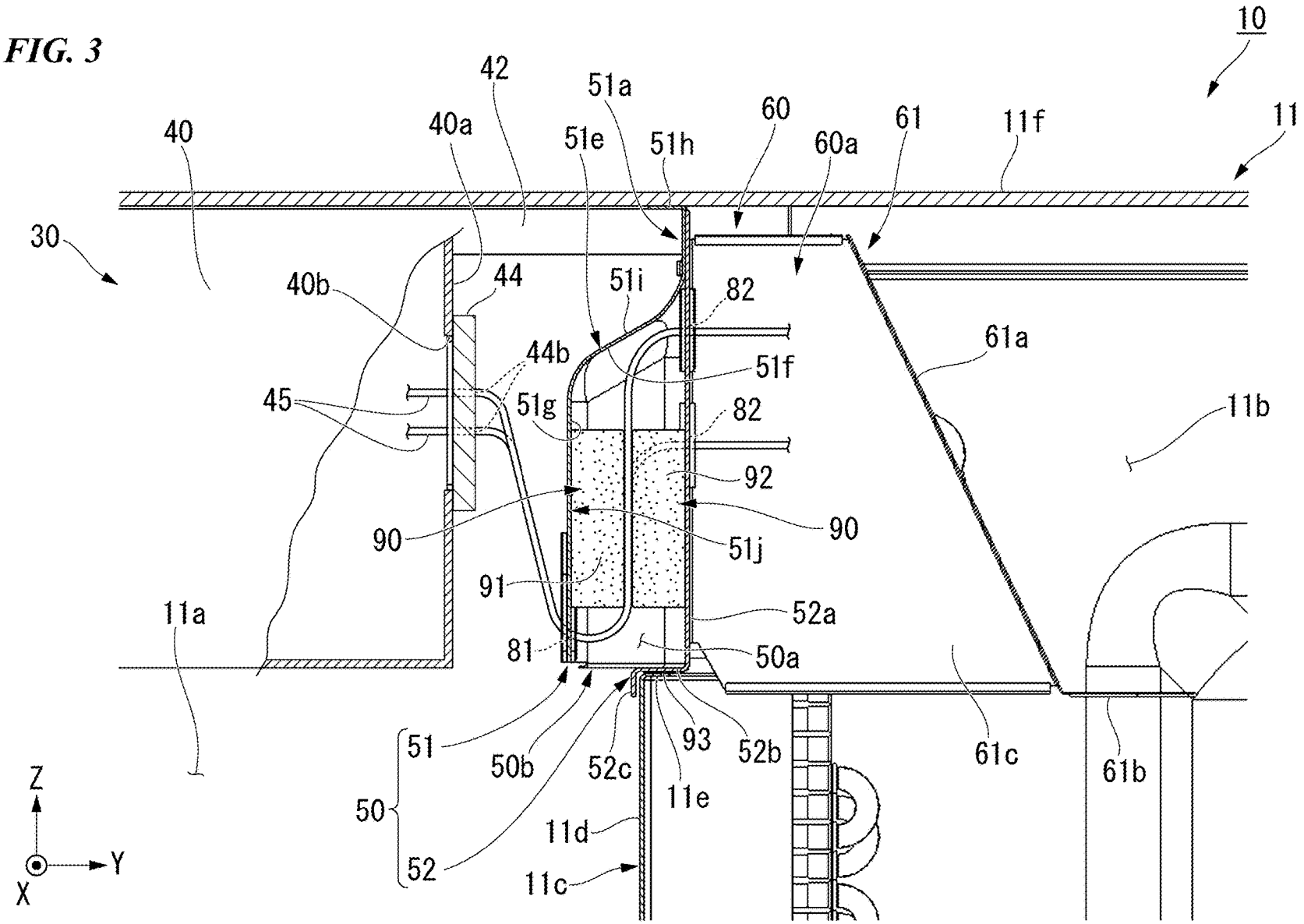
FIG. 3 A partial cross-sectional view that shows a portion of the outdoor unit in the embodiment.

Next, the outdoor unit 10 is explained in further detail. FIG. 2 is a perspective view that shows a portion of the outdoor unit 10. FIG. 3 is a partial cross-sectional view that shows a portion of the outdoor unit 10. As shown in FIG. 2, the housing 11 has a blower room 11*a* and a mechanical room 11*b* that are partitioned from one another by a partition member 11*c*. In the present embodiment, the blower room 11*a* corresponds to a "first room", and the mechanical room 11*b* corresponds to a "second room".

The partition member 11*c* extends in the vertical direction Z As shown in FIG. 3, the partition member 11*c* has a partition plate 11*d* that extends in the vertical direction 7, and a bend 11*e* that bends to the right side from a top end of the partition plate 11*d*. The partition plate 11*d* is a semi-rectangular plate surface that faces the left-right direction Y. The bend 11*e* is a plate surface that faces the vertical direction Z The bend 11*e* is provided on an entirety of the top end of the partition plate 11*d* in the front-rear direction X. A top end of the partition member 11*c* is separately disposed to the bottom side from a ceiling surface panel 11*f* of the housing 11. The ceiling surface panel 11*f* is a wall portion located on the top side out of wall portions that configure the housing 11. The top end of the partition member 11*c* in the present embodiment is the bend 11*e*.

As shown in FIG. 2, the blower room 11*a* and the mechanical room 11*b* are adjacently disposed in the left-right direction Y. A dimension of the blower room 11*a* in the left-right direction Y is larger than a dimension of the mechanical room 11*b* in the left-right direction Y. The blower room 11*a* is located on the left side of the mechanical room 11*b*. A heat exchanger 13 and the blower 15 are disposed on an inside of the blower room 11*a*. The heat exchanger 13 in the present embodiment, as seen from the vertical direction Z, is approximately L shaped. The heat exchanger 13 has a first portion 13*a* that extends in the left-right direction Y as seen from the vertical direction 7, and a second portion 13*b* that extends to the front side (+X side) from an end on the left side of the first portion 13*a*. The first portion 13*a* is disposed on a rear end of the inside of the blower room 11*a*. A left end of the first portion 13*a* is exposed to an inside of the mechanical room 11*b*. The circulation pathway 18 which is disposed on the inside of the mechanical room 11*b* is connected to a right end of the first portion 13*a*. Accordingly, the refrigerant pipe 18*a* is connected to the heat exchanger 13. The second portion 13*b* is disposed on a left end of an inside of the blower room 11*a*. The blower 15 is located on a front side of the first portion 13*a* in the heat exchanger 13, and a right side of the second portion 13*b* in the heat exchanger 13, on the inside of the blower room 11*a*.

When the blower 15 is driven, the air is taken into the blower room 11*a* from an intake port not shown on the drawings, that is provided on a wall portion on the rear side (−X side) of the blower room 11*a*. The air that is taken into the blower room 11*a* passes through the heat exchanger 13, and is discharged to an outside of the housing 11 from an exhaust port not shown on the drawings, that is provided on a wall portion on the front side (+X side) of the blower room 11*a*. As such, the blower 15 sends the air to the heat exchanger 13.

The compressor 12 is disposed on the inside of the mechanical room 11*b*. The compressor 12 is disposed on a bottom side portion out of the inside of the mechanical room 11*b*. The compressor 12 is a semi-cylindrical shape that extends in the vertical direction 7 . . . . As shown in FIG. 1, the plurality of refrigerant pipes 18*a* are disposed on the inside of the mechanical room 11*b*.

Figure 4:
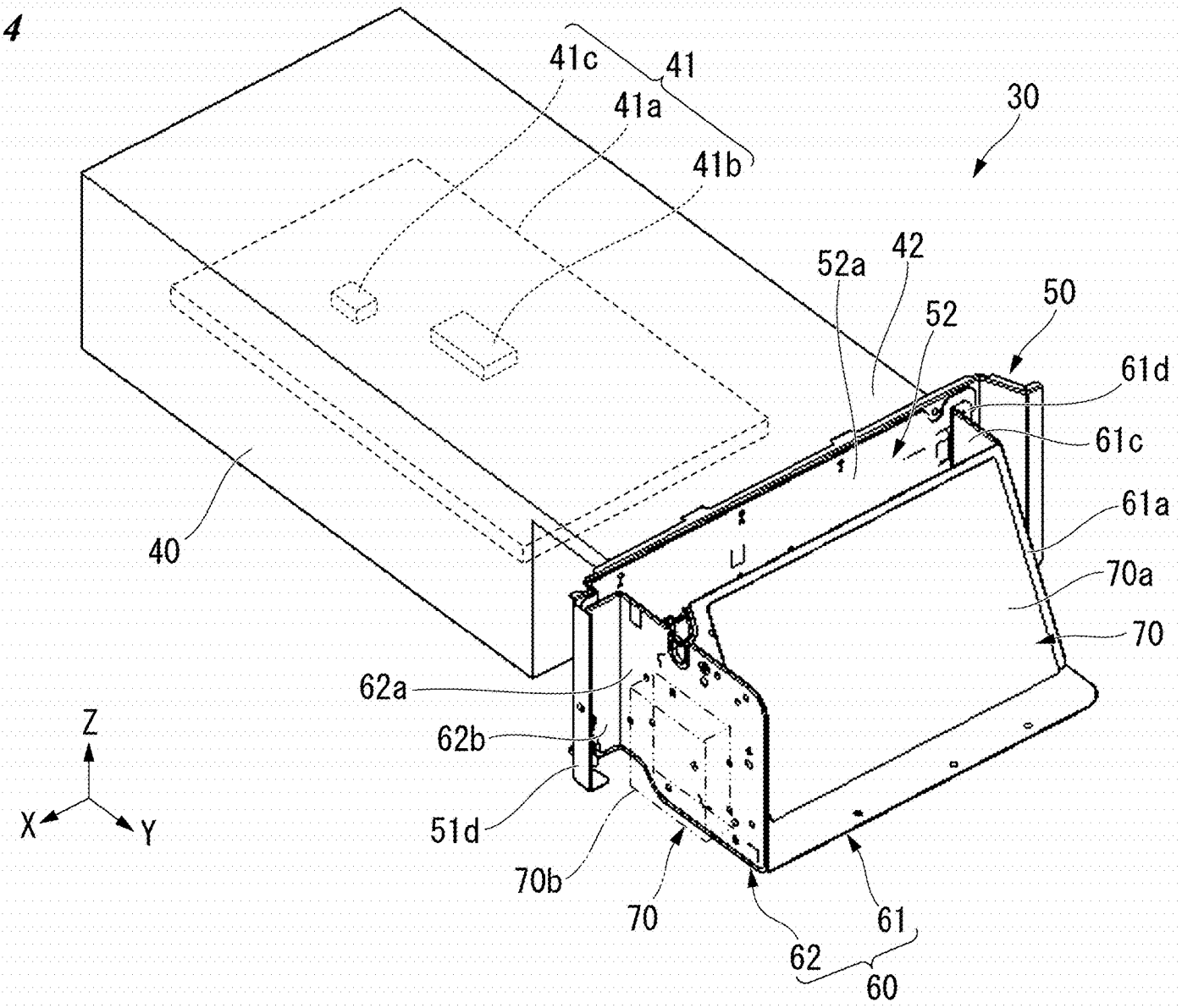
FIG. 4 A perspective view that shows a control unit in the embodiment.

The control unit 30 controls various parts of the outdoor unit 10. The control unit 30, for example, is a system controller that regulates control of an entirety of the refrigeration cycle device 100. As shown in FIG. 2, the control unit 30 is disposed so as to straddle between the inside of the blower room 11*a* and the inside of the mechanical room 11*b*. The control unit 30 extends in the left-right direction Y. FIG. 4 is a perspective view that shows the control unit 30. As shown in FIG. 4, the control unit 30 has an electric components box 40, a first electric part 41, a link 42, a wall member 50, a holding member 60, and a second electric part 70.

The electric components box 40 is for example, a long-rectangular box that extends in the left-right direction Y. As shown in FIG. 2, the electric components box 40 is disposed on the inside of the blower room 11*a*. The electric components box 40 is separately disposed on the top side of the blower 15, in the inside of the blower room 11*a*. The electric components box 40 is located on a top end portion, in the inside of the blower room 11*a*. The electric components box 40 is fixed to the housing 11. An end of the electric components box 40 on the right side, is separately located more to the left side than the partition member 11*c*.

Figure 5:
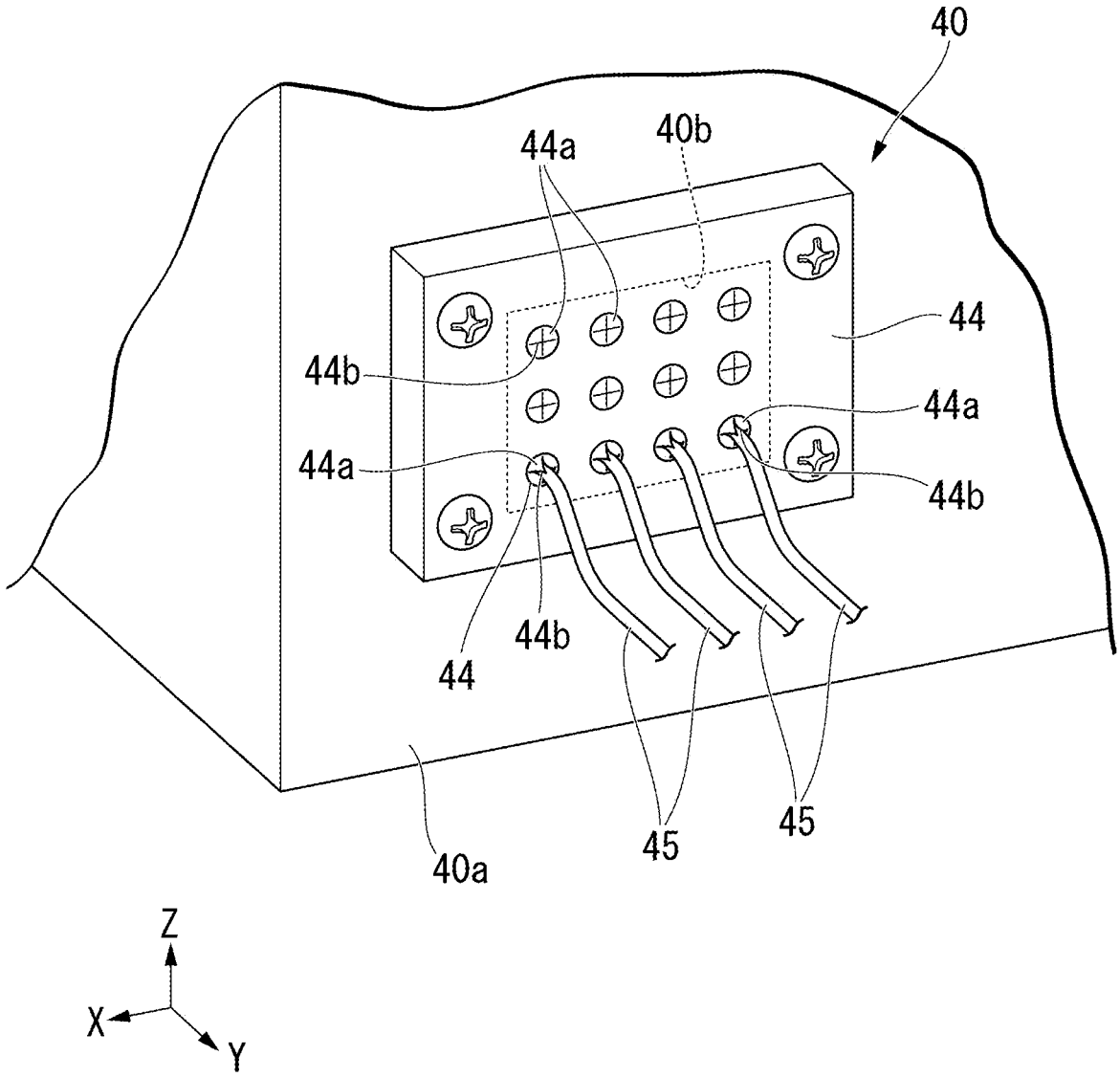
FIG. 5 A perspective view that shows a portion of an electric components box in the embodiment.

FIG. 5 is a perspective view that shows a portion of the electric components box 40. As shown in FIG. 5, a lead-out hole 40*b* is formed on the electric components box 40. The lead-out hole 40*b* in the present invention is formed on a right side wall 40*a* that is located on the right side (+Y side), out of the wall portions that configure the electric components box 40. The right side wall 40*a* is a wall on a side that is near to the mechanical room 11*b*, out of the wall portions of the electric components box 40 in the left-right direction Y. The lead-out hole 40*b* penetrates the right side wall 40*a* in the left-right direction Y. The lead-out hole 40*b* is square shaped. The lead-out hole 40*b* is formed on a center in the vertical direction 7, in a portion of the front side (+X side) out of the right side wall 40*a*.

A cover material 44 is fixed to a right side surface of the right side wall 40*a* of the electric components box 40. The cover material 44 plugs the lead-out hole 40*b* from an outside of the electric components box 40. The cover material 44 is a rectangular shaped material that flattens in the left-right direction Y. Each corner out of four corners of the cover material 44 as seen from the right side (+Y side) is fixed to the right side wall 40*a* using a bolt. The cover material 44 has a plurality of thin portions 44*a*. A thickness of a thin portion 44*a* compared to portions other than the thin portion 44*a* out of the cover material 44, is thinner in the left-right direction Y. At least one thin portion 44*a* out of the plurality of thin portions 44*a* has a wire hole 44*b* that passes a wire 45 to be mentioned later on, through formed therein. The wire hole 44*b* is formed for example, by cutting slits into the thin portion 44*a*.

The example of FIG. 5 shows a situation where all of the thin portions 44*a* have wire holes 44*b* formed therein. A portion of wires 45 that are inserted through the wire holes 45*b* however, are omitted from the drawing. For example, there is no need to form a portion of the thin portions 44*a* in a case where, compared to a number of wires 45, a number of the thin portions 44*a* is more. For example, it is possible for an operator conducting lead-out work of the wires 45 from within the electric components box 40 to cut slits onto the thin portions 44*a* to form a wire hole 44*b*, so as to only form the needed wire holes 44*b*.

A circumferential edge of the wire hole 44*b* is elastically deformable. The circumferential edge of the wire hole 44*b* in the present disclosure is formed by the thin portion 44*a*. The circumferential edge of the wire hole 44*b* is elastically deformable so as to be widened in a direction that the wire 45 is inserted through, when inserted through the wire hole 44*b*, while being in close contact with an outer surface of the wire 45. The cover material 44 may be configured of any material, so long as the circumferential edge of the wire hole 44*b* is elastically deformable. The material that the cover material 44 is configured from may be an elastomer of rubber or the like, or may be a resin.

As shown in FIG. 4, the first electric part 41 is housed on an inside of the electric components box 40. A plurality of first electric parts 41 are provided. The plurality of first electric parts 41 include a substrate 41*a*, a micro-computer 41*b*, and a connection component 41*c*. The substrate 41*a* is a rectangular shaped plate surface that faces the vertical direction Z The substrate 41*a* is a first control board having a control circuit mounted thereon, that controls the outdoor unit 10. The micro-computer 41*b* and the connection component 41*c* are attached to the substrate 41*a*. The micro-computer 41*b* conducts control of each part of the outdoor unit 10. The connection component 41*c* switches a connection state of a portion of the control circuit mounted on the substrate 41*a*.

The link 42 protrudes to the right side, from a top end of the electric components box 40. The link 42 is a flat rectangular shaped in the vertical direction Z As shown in FIG. 3, a right end of the link 42 is separately located on a top side of the partition member 11*c*. The link 42 is located on the top side more than the lead-out hole 40*b*.

Figure 6:
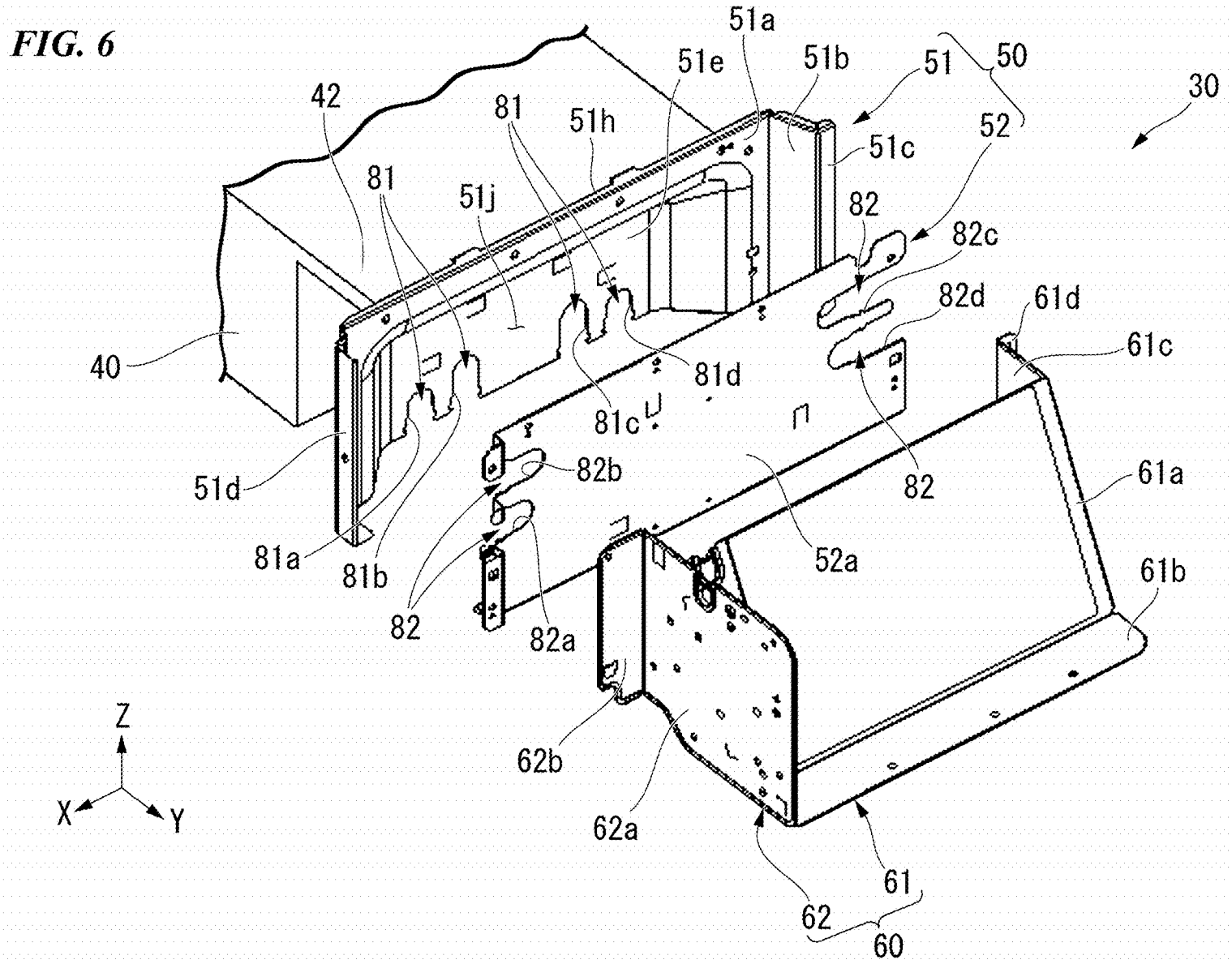
FIG. 6 An exploded perspective view that shows a portion of the control unit in the embodiment.

The holding member 60 is disposed on the inside of the mechanical room 11*b*. The holding member 60 is fixed to the electric components box 40 via the link 42 and the wall member 50. The holding member 60 is a member that holds the second electric part 70. FIG. 6 is an exploded perspective view that shows a portion of the control unit 30. As shown in FIG. 4 and FIG. 6, the holding member 60 has a first holding member 61, and a second holding member 62. The first holding member 61 and the second holding member 62 in the present embodiment are members that are different from one another. The first holding member 61 and the second holding member 62 are sheet metal members. The first holding material 61 and the second holding material 62 are fixed to one another.

As shown in FIG. 6, the first holding member 61 has a first holding wall 61*a*, a bottom wall 61*b*, a rear wall 61*c*, and a protruding wall 61*d*. The first holding wall 61*a* is a long semi-rectangular plate in the front-rear direction X. A plate surface of the first holding wall 61*a* inclines towards the left-right direction Y with respect to a plane (ZX plate) that is orthogonal to the left-right direction Y. The first holding wall 61*a* is located on the left side (−Y side) as the top side thereof is approached. The bottom wall 61*b* protrudes to the right side (+Y side), from a bottom end of the first holding wall 61*a*. The rear wall 61*c* protrudes to the left side, from the rear end of the first holding wall 61*a*. The protruding wall 61*d* protrudes to the rear side (−X side), from a left end of the rear wall 61*c*. The protruding wall 61*d* is fixed to a rear end of the second wall 52.

The second holding member 62 is located on a front side (+X side) of the first holding member 61. The second holding member 62 has a second holding wall 62*a*, and a protruding wall 62*b*. The second holding wall 62*a* is a semi-rectangular plate. A plate surface of the second holding wall 62*a* faces the front-rear direction X. The plate surface of the second holding wall 62*a* is surface that is orthogonal to the front-rear direction X. The second holding wall 62*a* is fixed to an end in the front side of the first holding wall 61*a*. The protruding wall 62*b* protrudes to the front side, from a left end of the second holding wall 62*a*. The protruding wall 62*b* is fixed to the second wall 52 to be mentioned later on.

As shown in FIG. 4, the second electric part 70 is held by the holding member 60. The second electric part 70 is electrically connected to the substrate 41*a* by the wires 45 to be mentioned later on. A plurality of second electric parts 70 is provided. The plurality of second electric parts 70 include a substrate 70*a* and a terminal block 70*b*. The substrate 70*a* is a plate surface which is a rectangular plate shape that faces the top side as well as the right side. The substrate 70*a* is held by the first holding member 61. More specifically, the substrate 70*a* is fixed to a surface that the top side of the first holding wall 61*a* faces. A sensor that is not shown on the drawings, and that is disposed on the inside of the mechanical room 11*b* is electrically connected to the substrate 70*a*. The substrate 70*a* is a second control board having a signal input thereto, from the sensor which is not shown on the drawings. A connection component is mounted on the substrate 70*a* as with the substrate 41*a*, and said connection component has explosion proof treatment applied thereto. As such, even if the refrigerant 19 leaks and comes into contact with said connection component, it is possible to suppress any failures from occurring. The terminal block 70*b* is held by the second holding member 62. The terminal block 70*b* is fixed to a surface on the front side (+X side) of the second holding wall 62*a* out of the second holding member 62.

As shown in FIG. 3, the wall member 50 is located on the top side of the partition member 11*c*. The wall member 50 is located between the partition member 11*c* and the ceiling surface panel 11*f* in the vertical direction Z The wall member 50 plugs a gap between the partition member 11*c* and the ceiling surface panel 11*f*. The wall member 50 has the first wall 51 and the second wall 52. The first wall 51 and the second wall 52 are members that are separate from one another. The wall member 50 is configured from the first wall 51 and the second wall 52 being fixed to one another.

The first wall 51 is located on the left side of the second wall 52. The first wall 51 is located between the electric components box 40 and the inside of the mechanical room 11*b* in the left-right direction Y. The first wall 51 is separately disposed from the right side of the electric components box 40. The first wall 51 is disposed so as to face the right side wall 40*a* of the electric components box 40 with an interval in between. As shown in FIG. 6, the first wall 51 extends in the front-rear direction X. The first wall 51 in the present embodiment is a sheet metal member. The first wall 51 has a first wall main body 51*a*, a rear wall 51*b*, a protruding wall 51*c*, a front wall 51*d*, and an eave wall 51*h*.

The first wall main body 51*a* extends in the front-rear direction X. The first wall main body 51*a* is a plate shape having a plate surface that faces the left-right direction Y. The first wall main body 51*a* is a long semi-rectangular shape in the front-rear direction X, as seen from the left-right direction Y. A top end of the first wall main body 51*a* is fixed to a right end of the link 42 by bolts.

The first wall main body 51*a* has a recessed wall 51*e*. The recessed wall 51*e* recesses to the left side (−Y side) more than portions other than the recessed wall 51*e* out of the first wall main body 51*a*. The recessed wall 51*e* in the present embodiment is a portion other than a top end portion, and portions on both ends in the front-rear direction X, out of the first wall main body 51*a*. As shown in FIG. 3, the recessed wall 51*e* protrudes to the left side. The recessed wall 51*e* has an inclined wall 51*i* that extends in an inclination direction with respect to the vertical direction Z The inclined wall 51*i* is located on the left side as the bottom side is approached.

A surface that faces the right side out of the recessed wall 51*e* is an opposite surface 51*j* that faces the second wall 52. The opposite surface 51*j* is a surface out of the first wall 51 that faces a first space 50*a*, to be mentioned later on. The opposite surface 51*j* has an inclined surface 51*f* and an extension surface 51*g*. The inclined surface 51*f* inclines to the left-right direction Y with respect to the vertical direction Z The inclined surface 51*f* is located on the left side, as the bottom side is approached. In other words, the inclined surface 51*f* inclines to a direction that approaches the electric components box 40, as the bottom side is approached in the vertical direction Z The inclined surface 51*f* faces the right side and the bottom side. The extension surface 51*g* extends to the bottom side from an end on the bottom side of the inclined surface 51*f*.

As shown in FIG. 6, the rear wall 51*b* protrudes to the right side, from a rear end of the first wall main body 51*a*. The protruding wall 51*c* protrudes to the rear side (+Y side), from a right end of the rear wall 51*b*. The front wall 51*d* protrudes to the right side, from a front end of the first wall main body 51*a*. The eave wall 51*h* protrudes to the left side, from the top end of the first wall main body 51*a*. The eave wall 51*h* extends in the front-rear direction X. The eave wall 51*h* is a plate shape having a plate surface that faces the vertical direction Z As shown in FIG. 3, the eave wall 51*h* is hooked onto a right end of the link 42 from the top side. Although not shown on the drawings, a sealing member is provided between the eave wall 51*h* and the ceiling surface panel 11*f*. Said sealing member is fixed to a bottom surface of the ceiling surface panel 11*f*.

As shown in FIG. 6, first through holes 81 that penetrate the first wall 51 in the left-right direction Y are formed on the first wall 51. In the present embodiment, the first through holes 81 are formed on a bottom end of the recessed wall 51*e*. The first through holes 81 penetrate the recessed wall 51*e* in the left-right direction Y. The first through holes 81 extend in the vertical direction Z The first through holes 81 open to the bottom side. Top ends of the first through holes 81 are semi-circular arcs that convex to the top side. The wires 45 to be mentioned later on are inserted through the first through holes 81.

A plurality of first through holes 81 are formed in the front-rear direction X with intervals therebetween. In the present embodiment, the first through holes 81 are formed from four through holes, a first through hole 81*a*, a first through hole 81*b*, a first through hole 81*c*, and a first through hole 81*d*. The first through hole 81*a*, the first through hole 81*b*, the first through hole 81*c*, and the first through hole 81*d* are aligned in such order, and face the rear side (−X side) from the front side (+X side). A top end of the first through hole 81*b* and a top end of the first through hole 81*c* are located more to the top side than a top end of the first through hole 81*a* and a top end of the first through hole 81*b*. An interval in the front-rear direction X between the first through hole 81*b* and the first through hole 81*c* is larger than the interval between the first through hole 81*a* and the first through hole 81*b* in the front-rear direction X, and the interval between the first through hole 81*c* and the first through hole 81*d* in the front-rear direction X.

Figure 7:
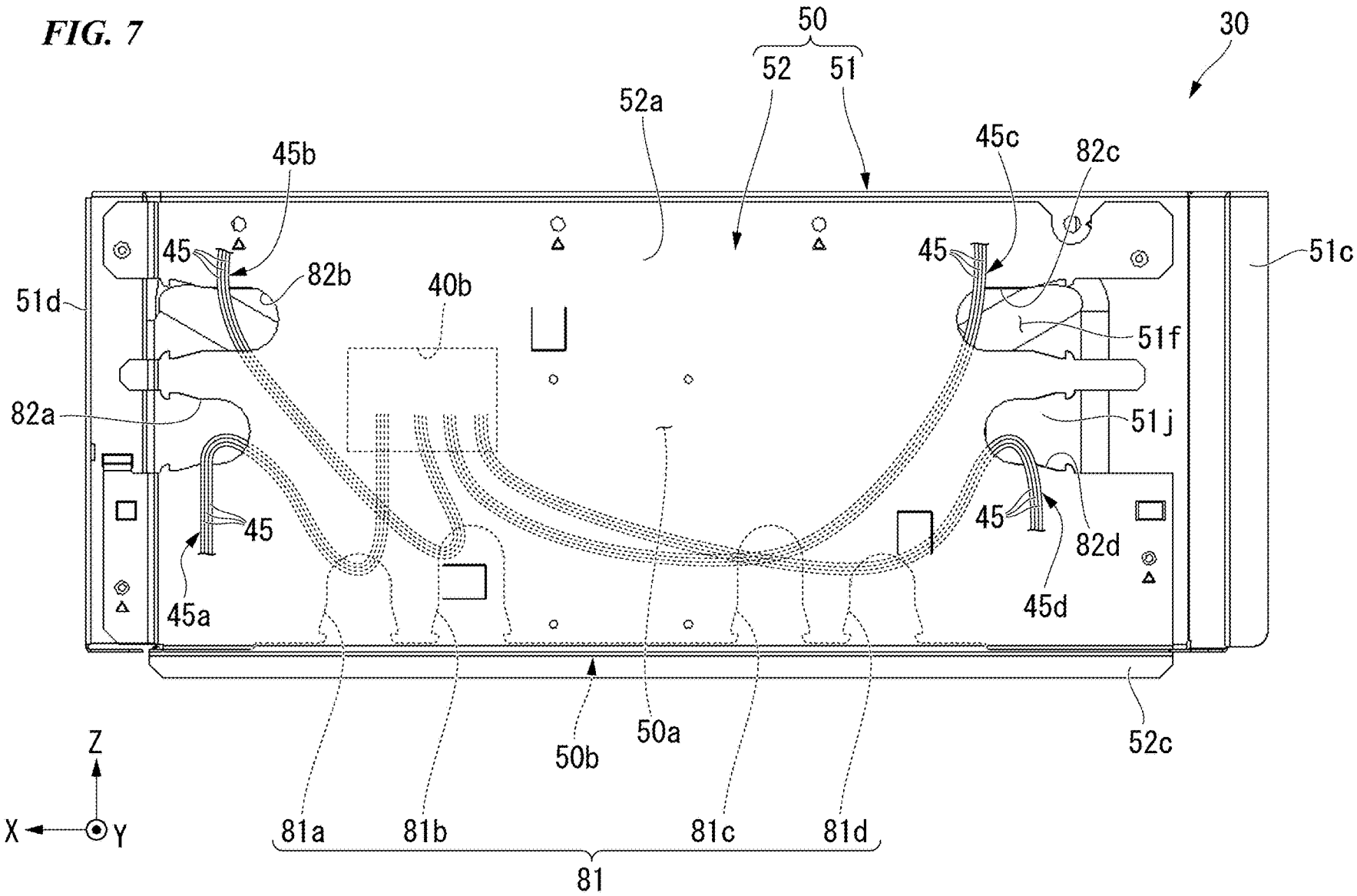
FIG. 7 A view showing a portion of the control unit as seen from a right side in the embodiment.

FIG. 7 is a view showing a portion of the control unit 30 as seen from the right side. In FIG. 7, the holding member 60 and the second electric parts 70 are omitted. As shown in FIG. 7, each through hole out of the first through holes 81 that is formed on the first wall 51 is located in the bottom side more than the lead-out hole 40*b*. The first through hole 81*a* and the first through hole 81*b* are located in the bottom side of the lead-out hole 40*b*, as seen from the left-right direction Y.

As shown in FIG. 3, the second wall 52 is located on a right side of the first wall 51. The second wall 52 is located between the first wall 51 and the inside of the mechanical room 11*b* in the left-right direction Y. As shown in FIG. 6 the second wall 52 extends in the front-rear direction X. A dimension of the second wall 52 in the front-rear direction X is smaller than a dimension of the first wall 51 in the front-rear direction X. The second wall 52 in the present embodiment is a sheet metal member.

The second wall 52 has a second wall main body 52*a*. The second wall main body 52*a* has a plate surface that faces the left-right direction Y, and is a long semi-rectangular shaped plate in the front-rear direction X. The second wall main body 52*a* is located on the right side of the first wall main body 51*a*. The second wall main body 52*a* is fixed to the first wall main body 51*a* by bolts. A portion of the bolt used to fix the second wall main body 52*a* to the first wall main body 51*a* mutually fastens the first wall 51 and the second wall 52 to the link 42. A top end of the second wall main body 52*a* is fixed to a top end of the first wall main body 51*a* by a bolt. Both ends of the second wall main body 52*a* in the front-rear direction X are each fixed to both ends of the first wall main body 51*a*. The second wall main body 52*a* covers the first wall main body 51*a* and the recessed wall 51*e* from the right side. The second wall main body 52*a* is located between the rear wall 51*b* and the front wall 51*d* in the front-rear direction X.

As shown in FIG. 3, the second wall 52 has a flange 52*b*. The flange 52*b* protrudes to the left side from an end of the bottom side of the second wall main body 52*a*. In other words, the flange 52*b* protrudes to a direction out of the left-right direction Y that approaches the first wall 51, from an end of the second wall main body 52*a* on the bottom side in the vertical direction. The flange 52*b* has a plate surface that faces the vertical direction 7, and is a long-thin rectangular shape that extends in the front-rear direction X.

The flange 52*b* is disposed on top of an end of the top side of the partition member 11*c* in the vertical direction. The flange 52*b* in the present embodiment is mounted on the top side of the bend 11*e* of the partition member 11*c*. A sponge material 93 is disposed between the flange 52*b* and the bend 11*e*. By sandwiching the sponge material 93 in the vertical direction Z between the flange 52*b* and the bend 11*e*, the sponge material 90 is in a state of compressive elastic deformation in the vertical direction Z The flange 52*b* and the bend 11*e* are connected via the sponge material 93.

The second wall 52 has an engagement portion 52*c* that protrudes to the bottom side from the left end of the flange 52*b*. The engagement portion 52*c* is a plate surface that faces the left-right direction Y, having a long thin rectangular shape that extends in the front-rear direction X. The engagement portion 52*c* is located on the left side of a top end of the partition plate 11*d* of the partition member 11*c*. In FIG. 3, the engagement portion 52*c* faces the left-right direction Y via an interval and the partition plate 11*d*. By having the engagement portion 52*c* hook onto the partition plate 11*d* from the left side, it is possible to suppress the wall member 50 from shifting to the right side with respect to the partition member 11*c*. Accordingly, a position in the left-right direction Y of the wall member 50 is determined with respect to the partition member 11*c*.

As shown in FIG. 6, two second through holes 82 that penetrate the second wall 52 in the left-right direction Y are formed on the second wall 52. The second through holes 82 in the present embodiment are formed on the second wall main body 52*a*. The second through holes 82 penetrate the second wall main body 52*a* in the left-right direction Y. The second through holes 82 extend in the front-rear direction X. The second through hole 82 opens to an edge of the second wall main body 52*a* in the front-rear direction X. A plurality of second through holes 82 are formed. In the present embodiment, the second through holes 82 are formed from four through holes, a second through hole 82*a*, a second through hole 82*b*, a second through hole 82*c*, and a second through hole 82*d*.

As shown in FIG. 7, the second through hole 82*a* and the second through hole 82*b* are formed on an end in the front side (+X side) of the second wall main body 52*a*. The second through hole 82*a* and the second through hole 82*b* open to the front side. Rear edges of second through holes 82*a* and 82*b* are semi-circular arcs that convex to the rear direction (−X side). The second through hole 82*a* and the second through hole 82*b* are adjacently disposed in the vertical direction 7, with an interval therebetween. The second through hole 82*a* is located on a bottom side of the second through hole 82*b*. A rear end of the second through hole 82*b* is located more to the rear side than a rear end of the second through hole 82*a*.

The second through hole 82*c* and the second through hole 82*d* are formed on an end in the rear side (−X side) of the second wall main body 52*a*. The second through hole 82*c* and the second through hole 82*d* open to the rear side. Front ends of second through holes 82*c* and 82*d* are semi-circular are shapes that convex to the front side (+X side). The second through hole 82*c* and the second through hole 82*d* are adjacently disposed with an interval therebetween, in the vertical direction Z The second through hole 82*d* is located on the bottom side of the second through hole 82*c*. A front end of the second through hole 82*c* is located on the front side more than the second through hole 82*d*.

The second through holes 82 in the second wall 52 are located on the top side more than the first through holes 81 that are formed on the first wall 51. In the present embodiment, the first through holes 81 that are formed on the first wall 51 and the lead-out hole 40*b*, and the second through holes 82 that are formed on the second wall 52, are disposed in locations that are offset from one another. Top ends of second through holes 82*b* and 82*c* are located on the top side more than the lead-out hole 40*b*. In the present embodiment, except for the bottom sides thereof, the second through holes 82*b* and 82*c* are located on the top side more than an entirety of the lead-out hole 40*b*. Bottom ends of the second through holes 82*a* and 82*d* are located more to the bottom side than the lead-out hole 40*b*. The second through holes 82*a* and 82*b* are located more to the front side (+X side) than the lead-out hole 40*b* and the first through hole 81. The second through holes 82*c* and 82*d* are located more to the rear side (−X side) than the lead-out hole 40*b* and the first through hole 81. The second through holes 82 face the opposite surface 51*j* of the first wall 51, in the left-right direction Y. The second through hole 82*b* and the second through hole 82*c* incline towards the inclined surface 51*f* in the left-right direction Y.

Figure 8:
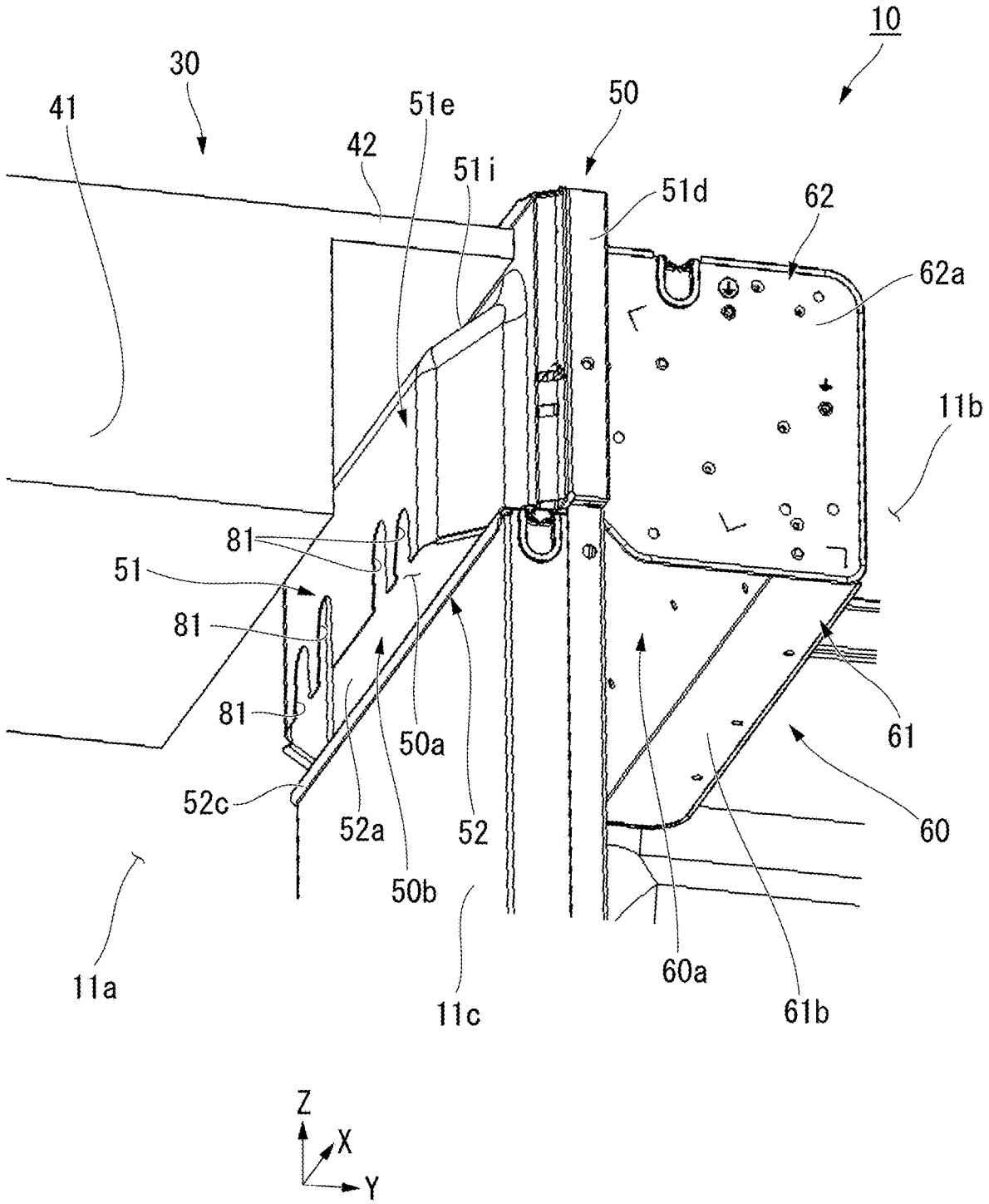
FIG. 8 A perspective view showing a portion of a partition member and a portion of the control unit in the embodiment.

FIG. 8 is a perspective view showing a portion of the partition member 11*c* and a portion of the control unit 30. As shown in FIG. 3 and FIG. 8, the first space 50*a* is formed between the first wall 51 and the second wall 52. The first space 50*a* in the present embodiment is a space that is surrounded by the recessed wall 51*e* out of the first wall 51, and the second wall main body 52*a* out of the second wall 52. By having a top end of the second wall main body 52*a* be fixed to a top end of the first wall main body 51*a*, an end of the top side out of the first space 50*a* is closed off. By having each end out of both ends in the front-rear direction X of the second wall main body 52*a* be fixed to each end out of both ends in the front-rear direction X of first wall main body 51*a*, both ends in the front-rear direction X out of the first space 50*a* are closed off.

The first space 50*a* has an opening 50*b* that opens to the bottom side. The opening 50*b* is a left side part out of ends on the bottom side of the first space 50*a*. The opening 50*b* opens to the inside of the blower room 11*a*. As shown in FIG. 3, a right side part out of ends on the bottom side of the first space 50*a* is closed by the flange 52*b* of the second wall 52. The opening 50*b* is located on the bottom side, more than the lead-out hole 40*b*. The opening 50*b* is formed between a bottom end of the first wall 51 and the left end of the flange 52*b*.

The control unit 30 includes the sponge material 90 disposed in the first space 50*a*. The sponge material 90 is a porous member that is elastically deformable. In the present embodiment, the sponge material 90 includes a first sponge material 91 and a second sponge material 92.

The first sponge material 91 is a surface that is attached to a surface out of the first wall 51 that faces the first space 50*a*, in other words, the opposite surface 51*j*. More specifically, the first sponge material 91 is attached to the extension surface 51*g*. The second sponge material 92 is attached to a surface out of the second wall 52 that faces the first space 50*a*, in other words, a surface on the left side of the second wall main body 52*a*. The first sponge material 91 and the second sponge material 92 are disposed so as to face the left-right direction Y. A portion of a surface on the right side of the first sponge material 91 and a portion of a surface on the left side of the sponge material 92 are in contact with one another. A portion in the vertical direction 7 out of the first space 50*a* is plugged by the first sponge material 91 and the second sponge material 92.

As shown in FIG. 3 and in FIG. 8, a second space 60*a* is formed between the wall member 50 and the holding member 60. The second space 60*a* in the present embodiment is a space that is surrounded by the second wall main body 52*a* of the second wall 52, the first holding wall 61*a* and the rear wall 61*c* of the first holding member 61, and the second holding wall 62*a* of the second holding member 62. The second space 60*a* is open to both sides in the vertical direction Z Both ends of the second space 60*a* in the vertical direction Z are open to the inside of the mechanical room 11*b*. As shown in FIG. 3, the second space 60*a* is connected to the first space 50*a* via the second through holes 82 that are formed on the second wall 52.

The control unit 30 has the wire 45 extend from the lead-out hole 40*b* formed on the electric components box 40, to the inside of the mechanical room 11*b*. A plurality of wires 45 are provided in the present embodiment. The plurality of wires 45 in the present embodiment includes the wire 45 connected to the second electric parts 70 in the mechanical room 11*b*, and the wire 45 connected to the compressor 12 in the mechanical room 11*b*. Out of the wires that are connected to the compressor 12 in the mechanical room 11*b*, a power line that supplies electric power to the compressor 12 is included.

An end of each of the wires 45 in the electric components box 40 is connected to the substrate 41*a*. Each of the wires 45 in the present embodiment are pulled out to an outside of the electric components box 40 from the inside of the electric components box 40, passing through the lead-out hole 40*b* and the wire hole 44*b*. The wire 45 that is pulled out to the outside of the electric components box 40 extends to the bottom side between the electric components box 40 and the first wall 51, passes through a through hole out of the first through holes 81, and enter the first space 50*a*. The wires 45 that have entered into the first space 50*a* extend to the top side to pass through the second through holes 82, and enter into the second space 60*a*. As such, a wire 45 extends from the inside of the blower room 11*a* to the inside of the mechanical room 11*b*, passes through a through hole out of the second through holes 82 that is formed on the first space 50*a* and the second wall 52. The wires 45 pulled out to the inside of the mechanical room 11*b* are connected to other components disposed on the inside of the mechanical room 11*b*, such as the second electric parts 70 or the compressor 12. Accordingly, the first electric parts 41 disposed on the inside of the blower room 11*a*, and the second electric parts 70 disposed on the inside of the mechanical room 11*b* are electrically connected to one another by the wires 45.

Out of the wires 45, at least a portion out of parts located on an inside of the first space 50*a* is sandwiched by the first sponge material 91 and the second sponge material 92. In the present embodiment, out of the wires 45, only a portion out of the parts located on the inside of the first space 50*a* is sandwiched between the first sponge material 91 and the second sponge material 92 in the left-right direction Y. A portion out of the wires 45 sandwiched between the first sponge material 91 and the second sponge material 92 is elastically deformable, and is in close contact to the wires 45.

As shown in FIG. 7, the plurality of wires 45 configure a plurality of wire bundles 45*a*. 45*b*, 45*c* and 45*d*, which are two or more wires 45 that are bundled together. In the present embodiment, four wire bundles, 45*a*, 45*b*, 45*c*, and 45*d* are formed. Wire bundle 45*a* is pulled out to the inside of the mechanical room 11*b*, passing through the first through hole 81*a* and the second through hole 82*a*. Wire bundle 45*b* is pulled out to the inside of the mechanical room 11*b*, passing through the first through hole 81*b* and the second through hole 82*b*. Wire bundle 45*c* is pulled out to the inside of the mechanical room 11*b*, passing through the first through hole 81*c* and the second through hole 82*c*. Wire bundle 45*d* is pulled out to the inside of the mechanical room 11*b*, passing through the first through hole 81*d* and the second through hole 82*d*.

The plurality of wires 45 configure each of the wire bundles 45*a*, 45*b*, 45*c*, and 45*d* by bundling a number of the wires 45, based on a purpose of each of the wires 45. Out of the plurality of wires 45, the wires 45 having a similar purpose are bundled together. In other words, purposes of the wires 45 in each of the wire bundles 45*a*, 45*b*, 45*c*, and 45*d* are different from one another. As an example, the wires 45 included in the wire bundle 45*a* connect the substrate 41*a* and the substrate 70*a*, and are used to transmit signals between the substrate 41*a* and the substrate 70*a*. The wires 45 included in the wire bundle 45*b* are power lines that supply electric power, which is supplied from the outside, to the electric parts of the second electric parts 70 or the like. The wires 45 included in the wire bundle 45*c* are power lines that are connected to the compressor 12, and supply electric power to the compressor 12. The wires 45 included in the wire bundle 45*d* are wires that are connected to a part that rectifies a high frequency current. The wires 45 of the wire bundles 45*a*, 45*b*, 45*c*, and 45*d* which have purposes that differ from one another are inserted through the mutually differing first through holes 81, and through the mutually differing second through holes 82.

In the present disclosure, the term "purposes of the wires . . . differ from one another" may refer to wires being connected to differing parts, or may refer to the wires being connected for differing purposes. The wires being connected for differing purposes for example, includes transmitting electrical signals, supplying electric power, or the like. For example, even if two wires are connected to the same part, if the two wires are connected for differing purposes, then said two wires have differing purposes from one another. Also, even if the two wires are connected for the same purpose, if the two wires are connected to differing parts, the two wires then have differing purposes from one another. The plurality of wire bundles 45*a*, 45*b*, 45*c* and 45*d* may include two or more of the wires 45 that mutually have the same purpose as one another.

According to the present embodiment, the control unit 30 includes the electric components box 40 disposed on the inside of the blower room 11*a*, the wires 45 that extend to the inside of the mechanical room 11*b*, after being pulled out from the lead-out hole 40*b* formed on the electric components box 40, the first wall 51 that is located between the electric components box 40 and the inside of the mechanical room 11*b*, and the second wall 52 that is located between the first wall 51 and the inside of the mechanical room 11*b*. Accordingly, even if the refrigerant 19 leaks from the refrigerant pipe 18*a* disposed on the inside of the mechanical room 11*b*, it is possible to at least obstruct a portion of the refrigerant 19 that has leaked using the first wall 51 and the second wall 52, making it possible to suppress the refrigerant 19 from flowing to the inside of the electric components box 40 of the blower room 11*a*. The refrigerant 19 that leaks to the inside of the mechanical room 11*b* may for example, be in a gaseous state.

According to the present embodiment, the first space 50*a* is formed as a space between the first wall 51 and the second wall 52. The wires 45 extend from the inside of the blower room 11*a* to the inside of the mechanical room 11*b*, via the first space 50*a* and the second through holes 82 that are formed on the second wall 52. A surface out of the first wall 51 that faces the first space 50*a* faces the second through holes 82 that are formed on the second wall 52, in the left-right direction Y. An end of the top side out of the first space 50*a* in the vertical direction, and both ends in the front-rear direction X that intersect with the vertical direction 7 out of the first space 50*a* and that are orthogonal to the left-right direction Y are closed. The first space 50*a* has the opening 50*b* that opens to the bottom side in the vertical direction. The opening 50*b* opens to the inside of the blower room 11*a*. Accordingly, even in a case where the refrigerant 19 that has leaked to the inside of the mechanical room 11*b*, passing through the second through holes 82, flows to the inside of the first space 50*a*, since the refrigerant 19 that has leaked to the inside of the first space 50*a* is intercepted by the opposite surface 51*j* which faces the first space 50*a* out of the first wall 51, it is possible to suppress the refrigerant 19 from moving towards the electric components box 40. The refrigerant 19 that collides with the opposite surface 51*j* flows along the opposite surface 51*j*, and flows to the inside of the blower room 11*a* from the opening 50*b*, to the bottom direction. Accordingly, it is possible to suppress the refrigerant 19 from heading towards the electric components box 40, while guiding the refrigerant 19 to the inside of the blower room 11*a* so as to have the refrigerant 19 disperse using the air flow generated by the blower 15. As such, it is possible to suppress the refrigerant 19 from being retained on the inside of the housing 11.

In a case where the refrigerant 19 is intensely exhausted to the inside of the mechanical room 11*b*, the exhausted refrigerant 19 is dispersed due to a collision with the second wall 52, and a speed of flow of the refrigerant 19 drops. As such, it is possible to suitably lower the speed of flow of the refrigerant 19 that passes through the second through holes 82 and flows to the inside of the first space 50*a*, and it is possible to suitably lower the speed of the flow of the refrigerant 19 that is discharged to the inside of the blower room 11*a* from the opening 50*b*. Accordingly, it is possible to suitably suppress the refrigerant 19 discharged from the opening 50*b* from flowing towards the lead-out hole 40*b*.

From the above, according to the present disclosure, it is possible to suitably suppress the refrigerant 19 from penetrating to the inside of the electric components box 40. Accordingly, it is possible to suppress the refrigerant 19 from causing any failures to the first electric parts 41 housed on the inside of the electric components box 40.

By simply providing a shield plate that covers the lead-out hole 40*b* for example, it would be possible to suppress the refrigerant 19 from leaking to the inside of the lead-out hole 40*b*. In such case however, the refrigerant 19 that is not blocked by the shield plate leaks into the lead-out hole 40*b*. Also, by the refrigerant 19 colliding with the shield plate, the refrigerant 19 flows towards an unintended direction or the like on the inside of the blower room 11*a*, and there is a risk of the refrigerant 19 leaking to the inside of the electric components box 40 from parts other than the lead-out hole 40*b* of the electric components box 40. In response to the above problems, in the embodiment of the present disclosure, by having the first space 50*a* that is formed between the first wall 51 and the second wall 52 only open to the bottom side, the refrigerant 19 that flows to the inside of the first space 50*a* is guided to the bottom side on the inside of the blower room 11*a*, and it is possible suppress the refrigerant 19 from reaching the lead-out hole 40*b*. Accordingly, it is possible to suppress the refrigerant 19 from flowing to an unintended direction on the inside of the blower room 11*a*, and it is possible to suppress the refrigerant 19 from leaking to the inside of the electric components box 40 from the top side of the electric components box 40 and/or from both sides or the like of the electric components box 40 in the front-rear direction X. Therefore, according to the present embodiment, compared to the previously mentioned case of simply providing the shield plate, it is possible to suitably suppress the refrigerant 19 from leaking to the inside of the electric components box 40.

According to the present embodiment, the control unit 30 has the first electric parts 41 housed on the inside of the electric components box 40, the holding member 60 disposed on the inside of the mechanical room 11*b*, and the second electric parts 70 that are held by the holding member 60. As such, by disposing a portion of the electric components included in the control unit 30 on the inside of the mechanical room 11*b*, it is easy to conduct connection work between sensors or the like that are disposed on the inside of the mechanical room 11*b*, and the control unit 30. Maintenance work or the like becomes easier to conduct by disposing the second electric parts 70, as parts that readily need maintenance work or the like conducted by the operator, on the inside of the mechanical room 11*b*. For example, by having parts that easily have failures generate when coming into contact with the refrigerant 19 be housed on the inside of the electric components box 40 as the first electric parts 41, it is possible to dispose the second electric parts 70 as parts that do not have failures generate easily when coming into contact with the refrigerant 19 on the inside of the mechanical room 11*b*. Accordingly, it is possible to suppress various parts of the control unit 30 from having failures generate due to the refrigerant 19, while making connection work and maintenance work or the like of the control unit 30 easier.

According to the present embodiment, the opening 50*b* of the first space 50*a* is located more to the bottom side in the vertical direction than the lead-out hole 40*b*. As such, it is possible to suitably suppress the refrigerant 19 that is discharged to the bottom direction from the opening 50*b*, from heading towards the lead-out hole 40*b*. Specifically, in a case where density of the refrigerant 19 in a gaseous state is larger than the density of air, since the refrigerant 19 in the gaseous state that is discharged from the opening 50*b* flows to the bottom direction due to gravity, it is possible to even more suitably suppress the refrigerant 19 discharged from the opening 50*b*, from heading towards the lead-out hole 40*b*. Therefore, it is possible to more suitably suppress the refrigerant 19 from leaking to the inside of the electric components box 40.

According to the present embodiment, the first through holes 81 are formed on the first wall 51 as through holes through which the wires 45 are inserted through. The first through holes 81 that are formed on the first wall 51 are located more to the bottom side in the vertical direction, than the lead-out hole 40*b*. As such, even in a case where the refrigerant 19 that has leaked to the inside of the first space 50*a* passes through the first through holes 81 and flows to the inside of the blower room 11*a*, it is possible to suppress the refrigerant 19 from flowing to the lead-out hole 40*b*. Specifically, in the case where the density of the refrigerant 19 in the gaseous state is larger than the density of air, it is possible to have the refrigerant 19 that passes through the first through holes 81 flow in a direction that is far from the lead-out hole 40*b*, and it is possible to further suppress the refrigerant 19 from flowing to the lead-out hole 40*b*. Therefore, it is possible to more suitably suppress leaking of the refrigerant 19 to the inside of the electric components box 40.

According to the present embodiment, the second through holes 82 which are through holes that are formed on the second wall 52 are located on the top side in the vertical direction, more than the first through holes 81 that are formed on the first wall 51. As such, the wires 45 that are pulled out from the lead-out hole 40*b*, extend to the top side of the inside of the first space 50*a* to pass through the second through holes 82, after extending to the bottom side to pass through the first through holes 81. Accordingly, it is possible to pull out the wires 45 from the lead-out hole 40*b* to the inside of the mechanical room 11*b*, by having the wires 45 meander in the vertical direction 7. Therefore, it is possible to suitably suppress the refrigerant 19 that has leaked to the inside of the mechanical room 11*b* from reaching the lead-out hole 40*b* by being transmitted using the wires 45. As such, it is possible to more suitably suppress the refrigerant 19 from leaking to the inside of the electric components box 40. Even when the refrigerant 19 is intensely discharged to the inside of the mechanical room 11*b*, as the refrigerant 19 flows through the second through holes 82, the first space 50*a*, and the first through holes 81 in such order, it is possible to more suitably weaken the flow intensity of the refrigerant 19. As such, it is possible to more suitably suppress the refrigerant 19 from intensely flowing towards the lead-out hole 40*b*. Accordingly, it is possible to more suitably suppress the refrigerant 19 from leaking to the inside of the electric components box 40.

According to the present embodiment, the lead-out hole 40*b*, the first through holes 81 that are formed on the first wall 51, and the second through holes 82 that are formed on the second wall 52 are located so as to be offset from one another, as seen from the left-right direction Y. As such, it is possible to make the route of the wires 45 that pass through the lead-out hole 40*b*, the first through holes 81, and the second through holes 82 more complex, and it is possible to more suitably suppress the refrigerant 19 that flows to the inside of the first space 50*a* from the second through holes 82, from reaching the lead-out hole 40*b* by being transmitted using the wires 45. Accordingly, it is possible to more suitably suppress the refrigerant 19 from leaking to the inside of the electric components box 40. According to the present embodiment, the lead-out hole 40*b*, the first through holes 81 that are formed on the first wall 51, and the second through holes 82 that are formed on the second wall 52 are disposed so as to be offset from one another in the vertical direction 7, and in the front-rear direction X. As such, it is possible to make the route of the wires 45 passing through the lead-out hole 40*b*, the first through holes 81, and the second through holes 82 more complex, and it is possible to more suitably suppress the refrigerant 19 from reaching the lead-out hole 40*b* by being transmitted using the wires 45. Accordingly, by being able to make the route which the wires 45 passing through the lead-out hole 40*b*, the first through holes 81, and the second through holes 82 be more complex, it is also possible to suppress foreign substances such as rain water or the like that has leaked to the inside of the blower room 11*a* from leaking to the inside of the mechanical room 11*b* by being transmitted using the wires 45.

According to the present embodiment, the wires 45 are provided in plurality. The first through holes 81 that formed on the first wall 51, and the second through holes 82 that are formed on the second wall 52, are each formed in plurality. Two or more wires 45 of the plurality of wires 45 bundled together configure the plurality of wire bundles 45*a* to 45*d*. The plurality of wire bundles 45*a* to 45*d* include at least two wire bundles that mutually have differing purposes of the wires 45, and said at least two wire bundles are inserted through the first through holes 81 and the second through holes 82 that differ from one another. As such, it is possible to separately dispose two wires 45 that have differing purposes, in between said at least two wire bundles.

As the purpose of the wires 45 differs, there are cases where a size of noise generated from the wires 45, and the size of failures generated as a result of wires 45 receiving noise effects differ. Specifically, for example, the noise generated by the wire 45 which is the power line of the compressor 12, and the wire 45 which is connected to the part that rectifies the high frequency current, is higher than the noise generated by the wire 45 which is a power line that supplies electric power to the second electric parts 70 or the like, and the wire 45 which is a transmission line that connects the substrates 41*a* and 70*a* to one another. In other words, the size of the noise generated in the wires 45 that are included in the wire bundles 45*c* and 45*d*, is larger than the size of the noise generated in the wires 45 that are included in the wire bundles 45*a* and 45*b*. The noise generated by the wire 45 which is a power line that supplies electric power to the second electric parts 70 or the like, in other words the wire 45 included in the wire bundle 45*b*, is larger than the noise generated by the wire 45 which is a transmission line that connects the substrates 41*a* and 70*a* to one another, in other words the wire 45 included in the wire bundle 45*a*.

When noise is transferred from the other wires 45 to the wire 45, which is the transmission line that is included in the wire bundle 45*a*, there are cases where a voltage signal that flows through the wire 45 of the wire bundle 45*a* is disrupted by the noise effects. As such, the size of the failure that is generated from the noise effects being received by the wire 45 of the wire bundle 45*a* is larger than the size of the failure that is generated from the noise effects being received by the other wire bundles 45*b*, 45*c*, and 45*d*. Therefore, it is preferable that the wire 45 of the wire bundle 45*a* be separately disposed from the wire bundles 45*b*, 45*c*, and 45*d*, so that the noise generated in the other wires 45 does not transfer to the wire 45 of the wire bundle 45*a*.

In the present embodiment, since the wire bundle 45*a* is inserted through the first through holes 81 and second through holes 82 that are different from the through holes through which the wire bundles 45*b*, 45*c*, and 45*d* having different purposes are inserted through, it is possible to suitably and separately dispose the wire 45 included in the wire bundles 45*a* from the wire bundles 45*b*, 45*c*, and 45*d*. As such, it is possible to make the transfer of the noise generated in the wire bundles 45*b*, 45*c*, and 45*d* to the wire 45 of the wire bundle 45*a* more difficult. Therefore, it is possible to suppress the disruption of the voltage signal flowing through the wire 45 included in the wire bundle 45*a*, and it is possible to conduct better transmission between the substrates 41*a* and 70*a*. Specifically in the present embodiment, it is possible to dispose the wire bundles 45*c* and 45*d*, in which a relatively large noise generates more easily, on an opposite side of the wire bundle 45*a* in the front-rear direction X. Thus, it is possible to more suitably suppress the wire 45 included in the wire bundle 45*a* from receiving the noise effects.

There are cases where the noise generated from the wire 45 included in the wire bundle 45*b* is used to obtain a noise standard. As such, it is preferable to have the noise effects generated in the other wires 45 not be easily received by the wire 45 included in the wire bundle 45*b*. In the present embodiment, since the wire bundle 45*b* is inserted through the first through holes 81 and second through holes 82 that are different from the through holes through which the wire bundles 45*a*, 45*c*, and 45*d* having different purposes are inserted through, it is possible to suitably and separately dispose the wire 45 included in the wire bundles 45*b* from the wire bundles 45*a*, 45*c*, and 45*d*. Accordingly, it is possible to make the transfer of the noise generated in the wire bundles 45*a*, 45*c*, and 45*d* to the wire 45 of the wire bundle 45*b* more difficult. Therefore, it is possible to suitably measure the noise generated by the wire bundles 45*b*. Specifically, in the present embodiment, since it is possible to dispose the wire bundles 45*c* and 45*d*, in which a relatively large noise generates more easily, on the opposite side of the wire bundle 45*b* in the front-rear direction X, it is possible to more suitably suppress the noise effects received by the wire 45 included in the wire bundle 45*b*.

According to the present embodiment, with respect to the vertical direction 7, a surface out of the first wall 51 that faces the first space 50*a*, in other words the opposite surface 51*j*, has the inclined surface 51*f* that inclines towards a direction that approaches the electric components box 40 as the bottom side in the vertical direction is approached, and has the extension surface 51*g* that extends to the bottom side in the vertical direction from an end in the bottom side of the inclined surface 51*f* in the vertical direction. The inclined surface 51*f* faces the second through holes 82 formed on the second wall 52 in the left-right direction Y. As such, it is possible to have the refrigerant 19 that passes through the second through holes 82 in the left-right direction Y and flows to the inside of the first space 50*a* from the inside of the mechanical room 11*b*, be suitably guided to the bottom side, by having the refrigerant 19 collide with the inclined surface 51*f*. The refrigerant 19 that is guided to the bottom side by the inclined surface 51*f* flows to the bottom side along the extension surface 51*g*, and is discharged to the bottom direction from the opening 50*b* to the inside of the blower room 11*a* from the rear wall 51*b*. Accordingly, it is possible to suppress the refrigerant 19 from reaching the inside of the lead-out hole 40*b*. Therefore, it is possible to more suitably suppress the refrigerant 19 from leaking to the inside of the electric components box 40. When the material of the first wall 51 is sheet metal, and the recessed wall 51*e* is made by press working, by making a shape of the recessed wall 51*e* be a shape where the inclined surface 51*f* is provided, making of the recessed wall 51*e* becomes easier.

According to the present embodiment, the control unit 30 includes the lead-out hole 40*b* and the cover material 44. The cover material 44 has the wire hole 44*b* which passes the wire 45 through. The circumferential edge of the wire hole 44*b* is elastically deformable. As such, it is possible to plug the lead-out hole 40*b* by the cover material 44, while having the circumferential edge of the wire hole 44*b* be in close contact with the wire 45. Accordingly, even when in a case where the refrigerant 19 flows close to the lead-out hole 40*b*, it is possible to suppress the refrigerant 19 from leaking to the inside of the lead-out hole 40*b* using the cover material 44. Therefore, it is possible to more suitable suppress the refrigerant 19 from leaking to the inside of the electric components box 40.

For example, if portions out of the lead-out hole 40*b* other than the portion that passes the wire 45 is completely plugged, it is possible to prevent the refrigerant 19 from leaking to the inside of the electric components box 40 via the lead-out hole 40*b*. However, in such case, depending on a material used to plug the lead-out hole 40*b*, there is a need to strongly fix the wire 45 to the electric components box 40, and removal of the wire 45 from the electric components box 40 becomes difficult. As such, a problem of not being able to exchange the wire 45 or the like arises. In contrast to the above, in the present embodiment, since a configuration where the cover material 44 is attached to the lead-out hole 40*b*, and the wire 45 is inserted through the wire hole 44*b*, removing the wire 45 from the wire hole 44*b* is easy. Since it is possible to suppress the refrigerant 19 from leaking to the inside of the electric components box 40 from the lead-out hole 40*b* using the previously mentioned first wall 51 and the second wall 52, even if the lead-out hole 40*b* is not plugged, the aforementioned is still sufficient in suppressing the refrigerant 19 from leaking to the inside of the electric components box 40. As such, by plugging the lead-out hole 40*b* using the cover material 44, it is possible to suitably suppress the refrigerant 19 from leaking to the inside of the electric components box 40 via the lead-out hole 40*b*.

According to the present embodiment, the control unit 30 has the sponge material 90 disposed in the first space 50*a*. As such, it is possible to decrease the speed of flow of the refrigerant 19 that flows to the inside of the first space 50*a*, using the sponge material 90. As such, it is possible to prevent the refrigerant 19 from intensely flowing to the inside of the blower room 11*a*, and it is possible to more suitably suppress the refrigerant 19 from leaking to the inside of the electric components box 40. When foreign substances such as rain water or the like leak to the inside of the blower room 11*a* from the outside of the outdoor unit 10, even if said foreign substances make it to the inside of the first space 50*a*, it is possible to intercept said foreign substances using sponge material 90. As such, it is possible to suppress foreign substances such as rain water or the like from leaking to the inside of the mechanical room 11*b* via the inside of the first space 50*a*. According to the present embodiment, since the second through holes 82 are located more to the top side than the lead-out hole 40*b*, it is possible to have the location of the second through holes 82 be relatively more to the top side in the vertical direction 7, and said foreign substances such as rain water or the like are suppressed from reaching an inside of the second through holes 82. As such, it is possible to further suppress said foreign substances such as rain water or the like from leaking to the inside of the mechanical room 11*b* via the second through holes 82.

According to the present embodiment, the sponge material 90 includes the first sponge material 91 which is attached to a surface out of the first wall 51 that faces the first space 50*a*, and the second sponge material 92 which is attached to a surface out of the second wall 52 that faces the first space 50*a*. Out of the wire 45, at least a portion out of a part located on the inside of the first space 50*a* is sandwiched between the first sponge material 91 and the second sponge material 92. As such, it is possible to suitably decrease the speed of flow of the flowing refrigerant 19 that is transmitted by the wire 45 using the first sponge material 91 and the second sponge material 92. It is also possible to stably hold the wire 45 on the inside of the first space 50*a*, using the first sponge material 91 and the second sponge material 92.

According to the present embodiment, the second wall 52 has the second wall main body 52*a*, and the flange 52*b* which protrudes to a direction out of the left-right direction Y that approaches the first wall 51, from an end of the second wall main body 52*a* on the bottom side in the vertical direction. The flange 52*b* is disposed on top of the end of the partition member 11*c* on the top side in the vertical direction. As such, it is possible to suitably have the opening 50*b* of the first space 50*a* that is formed between the first wall 51 and the second wall 52 open to the inside of the blower room 11*a*, and not open to the mechanical room 11*b*. Accordingly, it is possible to have the refrigerant 19 that flows from the inside of the mechanical room 11*b* to the inside of the first space 50*a* to flow more easily from the opening 50*b* to the inside of the blower room 11*a*. Accordingly, it is possible to more suitably disperse the refrigerant 19 that has leaked using the blower 15.

According to the present embodiment, since the sealing member that is not shown on the drawings is provided between the eave wall 51*h* and the ceiling surface panel 11*f*, the refrigerant 19 that has leaked on the inside of the mechanical room 11*b* is suppressed from flowing to the top side of the electric components box 40, from in between the first wall 51 and the ceiling surface panel 11*f*. Accordingly, it is possible to suppress the refrigerant 19 from leaking to the inside of the electric components box 40, from the top side of the electric components box 40.

Although embodiments of the present disclosure have been explained above, the present disclosure is not limited to the configurations of the embodiment previously mentioned, and the configurations and methods below may be adopted.

A first wall and a second wall may be an integral member. So long as a control unit is disposed so as to straddle between an inside of a first room (the blower room 11*a*) and an inside of a second room (the mechanical room 11*b*), a part out of the control unit that is disposed on the inside of the second room may be any part. For example, electric components need not be disposed on the inside of the second room, and only a supporting member that supports a wire which extends from an inside of an electric components box may be disposed.

A layout relationship of a lead-out hole, a through hole (the first through hole 81) that is formed on the first wall, and a through hole (the second through hole 82) that is formed on the second wall, may be any layout relationship. A number of the through holes that are formed on the first wall, and a number of the through holes that are formed on the second wall are not particularly limited. The through hole through which the wire passes through need not be formed on the first wall. A surface out of the first wall that faces a space (the first space 50*a*) need not include an inclined surface and/or an extension surface, and may be a surface that has any shape.

A number of the wires that extend from the lead-out hole formed on the electric components box to the inside of the second room is not particularly limited. When providing a plurality of wires, the plurality of wires may be bundled and inserted through the through hole that is formed on the first wall, and/or the through hole that is formed on the second wall. The plurality of wires need not be bundled, and may also be individually inserted through each of the differing through holes. A target to which the wires are connected to, on the inside of the second room is not particularly limited. The control unit need not include a cover material that plugs the lead-out hole. The control unit need not include a sponge material that is disposed in the space (the first space 50*a*).

A heat exchange unit according to the present disclosure may be an indoor unit of a refrigeration cycle device. The refrigeration cycle device that includes the heat exchange unit in the present disclosure may be a device that utilizes a refrigeration cycle having a refrigerant that circulates within, and is not limited to an air-conditioning unit. The refrigeration cycle device may be a heat pump of a water heater.

The various configurations and various methods explained in the above specification may be combined as needed, so long as no conflicts in the technical scope thereof occurs.

REFERENCE SIGNS LIST

10 . . . Outdoor Unit (Heat Exchange Unit), 11 . . . Housing, 11*a* . . . Blower Room (First Room), 11*b* . . . Mechanical Room (Second Room), 11*c* . . . Partition, 13 . . . Heat Exchanger, 15 . . . Blower, 18*a* . . . Refrigerant Pipes, 19 . . . Refrigerant, 20 . . . Indoor Unit, 30 . . . Control Unit, 40 . . . Electric Components Box, 40*b* . . . Lead Out Hole, 41 . . . First Electric Parts, 44 . . . Cover Material, 44*b* . . . Wire Hole, 45 . . . Wires, 45*a*, 45*b*, 45*c*, 45*d* . . . Wire Bundle, 50*a* . . . First Space (Space), 50*b* . . . Opening, 51 . . . First Wall, 51*f* . . . Inclined Surface, 51*g* . . . Extension Surface, 52 . . . Second Wall, 52*a* . . . Second Wall Main Body, 52*b* . . . Flange, 60 . . . Holding Member, 70 . . . Second Electric Parts, 81, 81*a*, 81*b*, 81*c*, 81*d* . . . First Through Hole (Through Hole), 82, 82*a*, 82*b*, 82*c*, 82*d* . . . Second Through Hole (Through Hole), 90 . . . Sponge Material, 91 . . . First Sponge Material, 92 . . . Second Sponge Material, 100 . . . Refrigeration Cycle Device, X . . . Front-Rear Direction (Second Direction), Y . . . Left-Right Direction (First Direction), Z . . . Vertical Direction

The invention claimed is:

1. A heat exchange unit of a refrigeration cycle device comprises:

a housing having a first room and a second room that are portioned from one another by a partition member;

a heat exchanger that is disposed on an inside of the first room;

a blower that is disposed on the inside of the first room;

a refrigerant pipe that is disposed on an inside of the second room and that is connected to the heat exchanger, and a control unit that is disposed so as to straddle between the inside of the first room and the inside of the second room, wherein the first room and the second room are adjacently disposed in a first direction that intersects a vertical direction, the control unit has an electric components box disposed on the inside of the first room, a wire that extends to the inside of the second room after being pulled out from a lead-out hole, a first wall located between the electric components box and the inside of the second room, and a second wall located between the first wall and the inside of the second room, a space is formed between the first wall and the second wall, the wire extends from the inside of the first room to the inside of the second room, via the space, passing through a second through hole of second through holes that are formed on the second wall, a surface of the first wall that faces the space faces the second through hole of second through holes that are formed on the second wall in the first direction, an end of a top side of the space in the vertical direction is closed off, and both ends of the space in a second direction that intersects with the vertical direction and is orthogonal to the first direction of the space are closed off, the space has an opening that opens to the bottom side in the vertical direction, and the opening opens to the inside of the first room, the surface of the first wall that faces the space has an inclined surface that inclines to a direction that approaches the electric components box, as the bottom side is approached in the vertical direction, and an extension surface that extends to the bottom side from an end on the bottom side in the vertical direction of the inclined surface, and the inclined surface faces the second through holes that are formed on the second wall in the first direction.

2. The heat exchange unit according to claim 1, wherein the control unit has first electric parts that are housed on an inside of the electric components box, a holding member that is disposed on the inside of the second room, and second electric parts that are held by the holding member.

3. The heat exchange unit according to claim 2, wherein the opening is located between the bottom side and the lead-out hole in the vertical direction.

4. The heat exchange unit according to claim 3, wherein a first through hole of first through holes through which the wire passes through is formed on the first wall, and the first through hole of the first through holes formed on the first wall is located between the bottom side and the lead-out hole in the vertical direction.

5. The heat exchange unit according to claim 4, wherein the second through hole of second through holes that are formed on the second wall is located on the top side in the vertical direction, more than the first through hole of the first through holes formed on the first wall.

6. The heat exchange unit according to claim 5, wherein the lead-out hole, the first through hole of the first through holes formed on the first wall, and the second through hole of second through holes that are formed on the second wall are disposed so as to be offset from one another, as seen from the first direction.

7. The heat exchange unit according to claim 4, wherein the wires are provided in plurality, the first through hole of the first through holes formed on the first wall, and the second through hole of second through holes, are each formed in plurality, a wire bundle of a plurality of wire bundles is configured by two or more of the wires that are provided in plurality, the plurality of wire bundle include at least two of the wires which have purposes that differ from one another, and at least two of the wire bundles are inserted through two of the first through holes that differ from one another, and two of the second through holes that differ from one another.

8. The heat exchange unit according to claim 1, wherein the control unit further comprises a cover material that plugs the lead-out hole, the cover material has a wire hole, through which the wire is inserted, and a circumferential edge of the wire hole is elastically deformable.

9. The heat exchange unit according to claim 1, wherein the control unit further comprises a sponge material that is disposed in the space.

10. The heat exchange unit according to claim 9, wherein the sponge material includes a first sponge material that is attached to the surface of the first wall that faces the space, and a second sponge material that is attached to a surface of the second wall that faces the space, and at least a portion of the wire located on an inside of the space is sandwiched by the first sponge material and the second sponge material.

11. A refrigeration cycle device comprising:

an outdoor unit, and an indoor unit, wherein the outdoor unit or the indoor unit is the heat exchange unit according to claim 1.

12. A heat exchange unit of a refrigeration cycle device comprises:

a housing having a first room and a second room that are portioned from one another by a partition member;

a heat exchanger that is disposed on an inside of the first room;

a blower that is disposed on the inside of the first room;

a refrigerant pipe that is disposed on an inside of the second room and that is connected to the heat exchanger, and a control unit that is disposed so as to straddle between the inside of the first room and the inside of the second room, wherein the first room and the second room are adjacently disposed in a first direction that intersects a vertical direction, the control unit has an electric components box disposed on the inside of the first room, a wire that extends to the inside of the second room after being pulled out from a lead-out hole, a first wall located between the electric components box and the inside of the second room, and a second wall located between the first wall and the inside of the second room, a space is formed between the first wall and the second wall, the wire extends from the inside of the first room to the inside of the second room, via the space, passing through a second through hole of second through holes that are formed on the second wall, a surface of the first wall that faces the space faces the second through hole of second through holes that are formed on the second wall in the first direction, an end of the top side of the space in the vertical direction is closed off, and both ends of the space in a second direction that intersects with the vertical direction and is orthogonal to the first direction of the space are closed off, the space has an opening that opens to the bottom side in the vertical direction, and the opening opens to the inside of the first room, the second wall has a second wall main body, and a flange that protrudes to a direction out of the first direction that approaches the first wall, from an end of the second wall main body on the bottom side in the vertical direction, and the flange is disposed on top of an end of the top side of the partition member in the vertical direction.

* * * * *